US005118320A

United States Patent [19]

Miller

[11] Patent Number: 5,118,320

[45] Date of Patent: Jun. 2, 1992

[54] ROLLER COASTER TOY

[76] Inventor: Richard G. Miller, 4129 Hood #E, Burbank, Calif. 91505

[21] Appl. No.: 604,216

[22] Filed: Oct. 29, 1990

[51] Int. Cl.[5] ..... A63H 17/25; A63H 21/04

[52] U.S. Cl. ..... 446/288; 446/445; 104/55; 104/245

[58] Field of Search ..... 446/444, 445, 446, 230, 446/231, 279, 288, 326, 325, 330, 168; 104/53, 55, 56, 245

[56] References Cited

U.S. PATENT DOCUMENTS

| | | | |
|---|---|---|---|
| 1,405,213 | 1/1922 | Hingenitz | 104/55 |
| 2,727,334 | 12/1955 | Ostrander | 446/325 X |
| 3,428,310 | 2/1969 | Leath | 446/444 X |
| 3,604,148 | 9/1971 | Neuhierl | 446/230 X |
| 4,357,778 | 11/1982 | Matsumoto et al. | 446/444 |

FOREIGN PATENT DOCUMENTS

| | | | |
|---|---|---|---|
| 937633 | 1/1956 | Fed. Rep. of Germany | 446/444 |
| 1039258 | 8/1966 | United Kingdom | 446/445 |

*Primary Examiner*—Mickey Yu
*Attorney, Agent, or Firm*—Roger A. Marrs

[57] ABSTRACT

A roller coaster or gravity motive toy is disclosed herein having a tortuous elevated track layout and toy vehicle system including adjustable support stanchions for the track attached thereto by a universal joint. The vehicle includes rollers movably supporting the vehicle on the track with pivotal roller guide and lateral securement elements to detachably couple the vehicle to the track. An articulated figure or caricature is carried in the vehicle having pivotal extremities adapted for centrifugal actuation during travel of the vehicle. A motorized lift is operably carried on the track selectively engaging with a vehicle lifting the vehicle to an elevated starting position for gravity operation.

7 Claims, 2 Drawing Sheets

ROLLER COASTER TOY

BACKGROUND OF THE INVENTION

1. Field of the Invention

The present invention relates to mechanical toys and more particulary to a novel combined toy vehicle track having an elevated tortuous path over which a gravity operated rolling toy vehicle travels.

2. Brief Description of the Prior Art

In the past, small toy vehicles have become extremely popular and these vehicles are usually employed in combination with joined track sections that allow various track layouts to be constructed. A very popular form of toy vehicle is a scaled automobile having a metal body which rides on freely rotatable wheels along the path provided by the track. Usually the track employs siderails or channel-shaped flanges for the purpose of guiding the toy vehicle along the running surface.

Problems and difficulties have been encountered when employing conventional mechanical toys which stem largely from the fact that construction of the track layout is extremely limited to linear runs of track, helical deployment of track and simple curvatures. The limited construction is due in part to the fact that no means are provided for height adjustment or track angle deployment. Such considerations are necessary when the toy vehicle is intended to be gravity operated wherein centrifugal force is used to advantage in propelling the toy vehicle along the course of the track.

Other problems have been encountered in gravity operated toys that reside in guiding the vehicle so that it does not leave the track during its travel and yet will not create drag or sufficient friction to obviate gravity operation. Conventional guide means for toy vehicles are generally concerned with lateral maintenance of the toy vehicle on the track. In the few instances, vertical guiding is provided which takes the form of deflection arms or the like that project over the track and are intended to be engaged by the roof of the toy vehicle during its travel along the path. In both of these instances, the guide means are carried on the track and the toy vehicle is void of any construction which engages the track other than its rollable wheels.

Therefore, a long standing need has existed to provide a mechanical toy having a track layout constructed of a plurality of joined track sections that may be readily adjusted in height and angled orientation so as to provide a tortuous path of travel for the toy vehicle. Also, guide means are preferably employed on the vehicle per se so that the track layout may be arranged to any desired configuration without concern over projections or other conventional guides which would encumber or become ineffective for gravity operated vehicles. The combination of small toy vehicles with freely rotatable wheels and adaptable track sections make for extremely exciting toy vehicle systems particularly when the user is provided with the capability of a variety of track layout and the like. Such additions as curves, loops, starting gates, finishing gates, lap counters or the like may be added to the track layout. In order to increase the excitement and to offer greater versatility to imaginative children, the use of gravity vehicles and adjustable track layout provides a novel and unusual mechanical toy. To be successful, however, each element of the vehicle and layout system must be simply constructed so as to inexpensively permit manufacture of the system so as to allow for mass marketing at a reasonable cost.

SUMMARY OF THE INVENTION

Accordingly, the above problems and difficulties are obviated by the present invention which provides a novel combined toy vehicle and track layout construction which includes a gravity operated toy vehicle movable along a track arranged in a tortuous path by means of towers or stanchions which not only elevate the track but couple to the track by universal means. In this manner, the track may be adjusted for height and angle providing a variety of layout choices to the user. The gravity operated vehicle is rollably carried on the track and the vehicle includes a pivoted roller guide arrangement which will rollably engage the track along three sides. A selected one of the rollers rides beneath the track and is connected to a hinged assembly which when activated causes the roller to swing in a lateral direction away from the track in order to allow quick placement to or removal from the track. A powered lift means is operably connected to the track for selectively engaging with a toy vehicle in order to lift the vehicle to an elevated starting position for gravity operation.

The novel coaster or gravity toy of the present invention realistically simulates the operation of a modern roller coaster. By employing the basic principles involved in the present invention, the user has the ability to design and create his or her own track layout, employing the physical properties of gravity and inertia in order to provide maximum excitement and entertainment while using a working, gravity powered vehicle.

Therefore, it is among the primary objects of the present invention to provide a novel mechanical toy having a gravity operated toy vehicle which travels over a tortuous path provided by an elevated track supported by adjustable height towers coupled to the track by a universal joint means.

Another object of the present invention is to provide a novel mechanical toy having a vehicle track layout adapted to be adjusted in a vertical direction as well as adapted to be adjusted in an angular manner whereby the user can take maximum advantage of centrifugal and inertial forces to provide an entertaining and exciting display.

Yet another object of the present invention is to provide a novel guide means for a toy vehicle rollably carried on a track wherein guide means are carried on the toy vehicle itself in rollable engagement with a track and wherein the guide means may be actuated laterally to engage or disengage the vehicle from the track.

Still another object of the present invention is to provide a novel mechanical toy having a gravity operated vehicle traveling along an elevated track which includes means carried on the vehicle for guiding the vehicle on the track regardless of gravity forces, centrifugal forces or inertial forces which are experienced during the travel along the length of track.

A further object of the present invention is to provide a novel track construction mounted on height adjusting towers and connected to the underside of the track by a universal means for pivotal or angular adjustment of the track whereby a variety of track layout is provided for the user.

Still yet another object is to provide a toy which will by its very use, teach the user, especially children, basic principles of physics such as gravity, inertia and laws of motion and how these principles are applied in the art of design and structural engineering.

BRIEF DESCRIPTION OF THE DRAWINGS

The features of the present invention which are believed to be novel are set forth with particularly in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
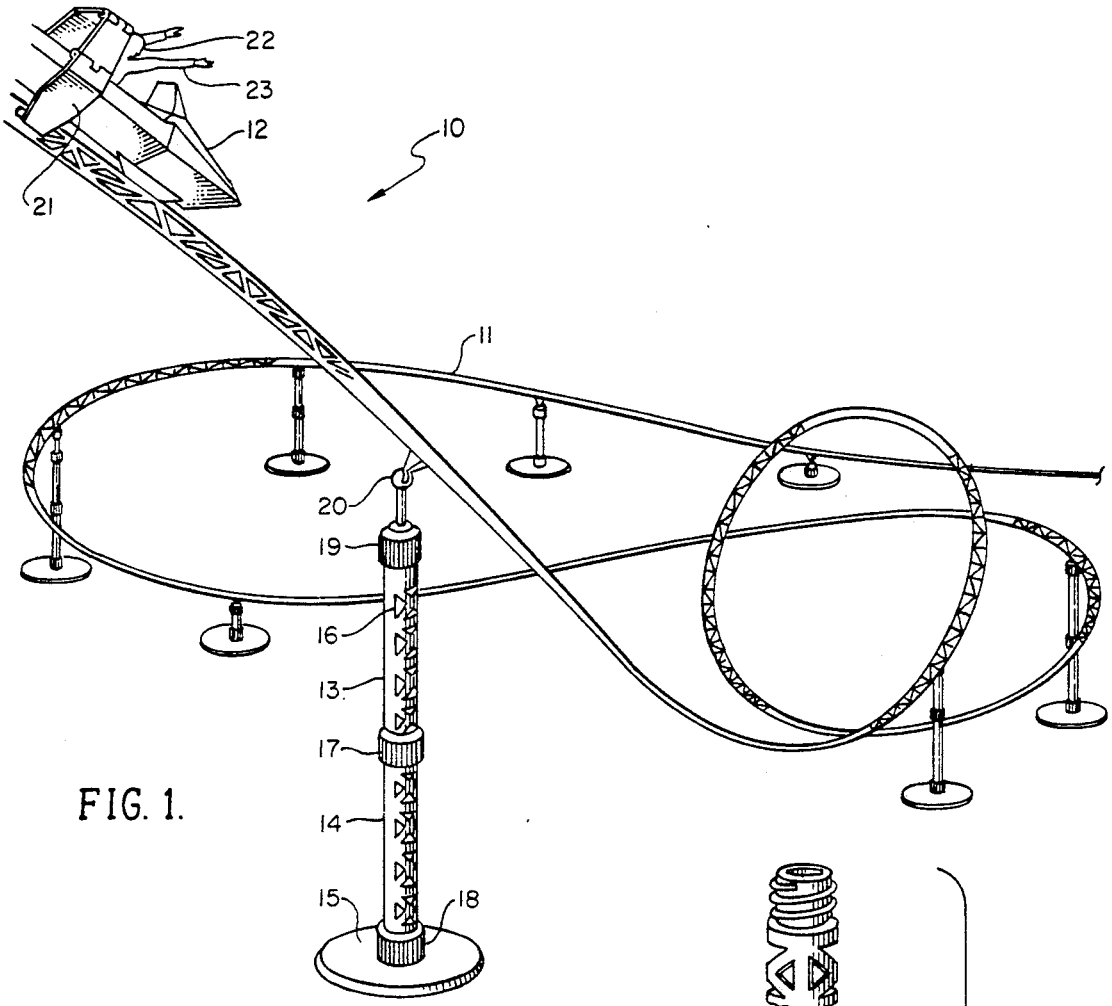
FIG. 1 is a front perspective view of a diagrammatic track layout and gravity operated vehicle in accordance with the present invention.

Referring to FIG. 1, the novel mechanical toy and track layout system incorporating the present invention is illustrated in the general direction of arrow 10. The track layout includes a plurality of track sections which are joined together to provide a continuous path as indicated by numeral 11 over which a gravity operated vehicle 12 can move. It is to be particularly noted that the track or path 11 is of a tortuous configuration including compound curves, elevated loops and banked or angled portions. The track is elevated by means of a plurality of spaced apart towers or stanchions such as tower 13 having a lower section 14 having one end anchored by means of a weighted disk or base 15. The opposite end of tower section 14 includes an upper section 16 that is coupled to the opposing end of section 14 by means of a threaded fastener 17. Threaded fasteners 18 and 19 are also used for coupling the tower at its opposite ends to the base 15 and to a universal joint 20 coupled to the underside of the track 11. By means of the threaded coupling, the track may be adjusted to raise or lower the height of the track while the universal joint 20 can be employed for angling or banking the track to either side of the tower on which the joint is carried.

The toy vehicle 12 includes rollers for movably supporting the car on the track; however, retaining and guide means are provided on the vehicle as indicated by numeral 21 for retaining the vehicle on the track as it is gravity operated along its length. A FIG. 22 is supported in the vehicle 12 and includes pivoted extremities such as arms 23 which will raise and fall in response to gravitational or inertial forces while the vehicle is traveling along the length of the track.

Figure 2:
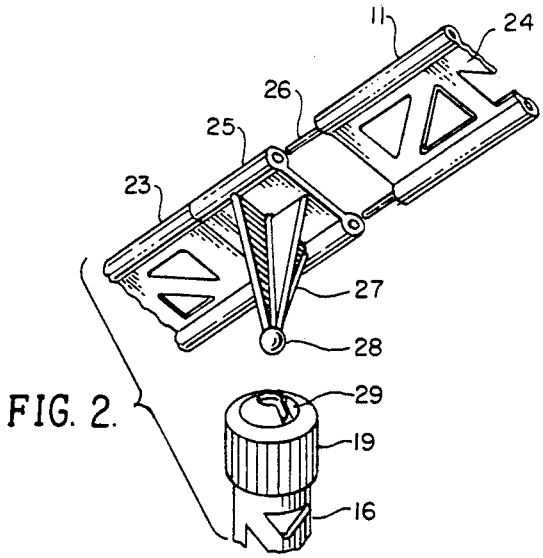
FIG. 2 is an enlarged perspective view showing the universal joint and track section connection used in the elevated track layout shown in FIG. 1.

Referring now in detail to FIG. 2, it can be seen that the track 11 includes sections 23 and 24 having their opposite ends joined together by means of a coupler section 25 which includes openings at the opposite end of the section to insertably receive pins, such as pin 26 on respective ends of the sections 23 and 24. Downwardly depending from the underside of the coupler section 25, there is a fixture 27 having a ball 28 carried on the end thereof which is insertably received within a socket member 29 carried on the end of the upper section 16 of stanchion 13. As the collar 19 is in threadable engagement with the end of the tower, rotation or turning of the collar will open and close the socket 29 respectively to loosen or tighten about the ball or sphere 28. In this, manner, adjustment may be made by loosening the collar 19 so that the ball can be rotated to adjust the track to the right or left of the tower. Also, adjustment may be made to other orientations in order to provide suitable angles for banking purposes since the coupling is of a universal movement construction.

Figure 3:
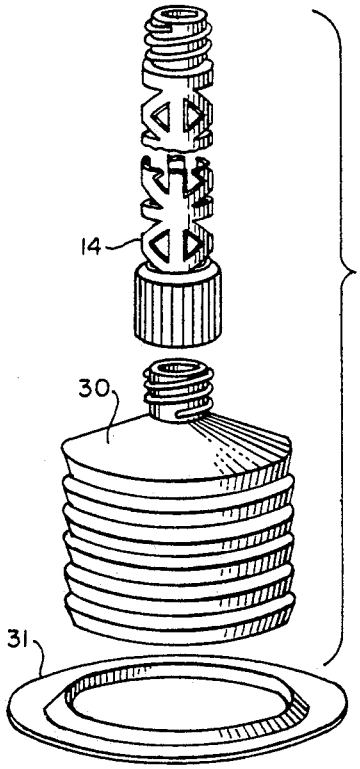
FIG. 3 is a perspective view showing a typical tower and anchor or base means used in the elevated track layout of FIG. 1.

Referring to FIG. 3, it can be seen that the base 15 may employ an alternate construction which takes a bulb or container 30 into which weighted material such as sand, water or other weighted elements can be placed so as to support the tower while in use. The container 30 may be suitably carried on a base 31 and the tower is coaxially disposed with respect to the container and the base.

Figure 4:
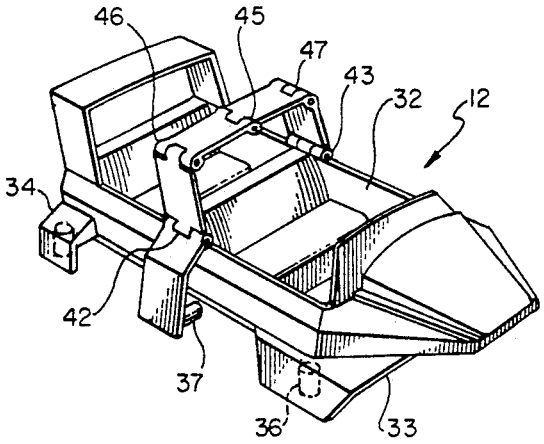
FIG. 4 is a perspective view of a gravity operated toy vehicle having combined retaining and guide means engagable with the track.
Figure 5:
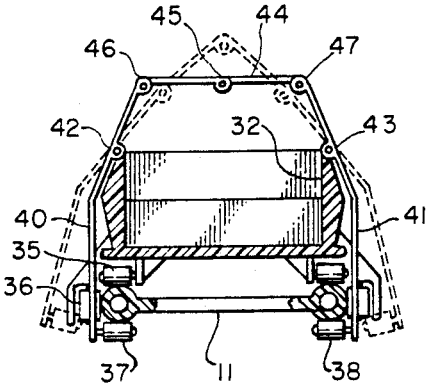
FIG. 5 is a transverse cross-sectional view of the vehicle shown in FIG. 4 illustrating the retaining and guide means in solid lines in its operative position and illustrating the same in its release position in broken lines.

Referring now in detail to FIG. 4, the gravity operated toy car 12 includes a frame or body 32 having a front carriage 33 and a rear carriage 34. Each of the respective carriages include an upper roller 35 as shown in FIG. 5 as well as a lateral roller 36 that engages the side of the track. Therefore, the vehicle may travel at whatever speed is generated by gravity propulsion on the lateral and top rollers 35 and 36 respectively. However, in order to retain and guide the vehicle on the track 11, lower rollers 37 and 38 are provided which are selectively disposed beneath the rails on each side of the track. An important feature of the present invention is that the lower rollers 37 and 38 are cantilevered inwardly towards one another from the inside surfaces of opposite side members 40 and 41 respectively. Members 40 and 41 are pivotally carried on the sides of the body 32 at pivot 42 and 43. The opposite ends of the side members 40 and 41 from their ends carrying the under rollers 37 and 38 are joined together by actuation member 44. This latter member includes 2 portions that are pivotally connected by pivot 45 and their opposite ends are pivotally connected to the ends of the side members 40 and 41 by means of pivots 46 and 47 respectively. As seen more clearly in FIG. 5, when pressure is exerted on the pivots 46 and 47 such as by the fingers of the user, the squeeze actuation will cause the members 40 and 41 to pivot outwardly so that the wheels for rollers 37 and 38 will clear the rails and the track 11. This would release the vehicle for removal from the track when desired. However, the normal spring bias of the members 40 and 41 to an inward direction will normally bias the wheels or rollers 37 and 38 to the position shown in solid line in FIG. 5. In broken lines, the actuator member 44 has been worked by the fingers of the user so that the vehicle is released.

The toy vehicles ride on the track and are futuristic in appearance and employ, preferably, plastic rollers which rollably engage along 3 sides of each rail of the track. The roller which rides beneath the rail is connected to the hinged assembly which when pinched, causes the rollers to swing outwardly in order to allow quick placement or removal of the vehicle from the track.

Figure 6:
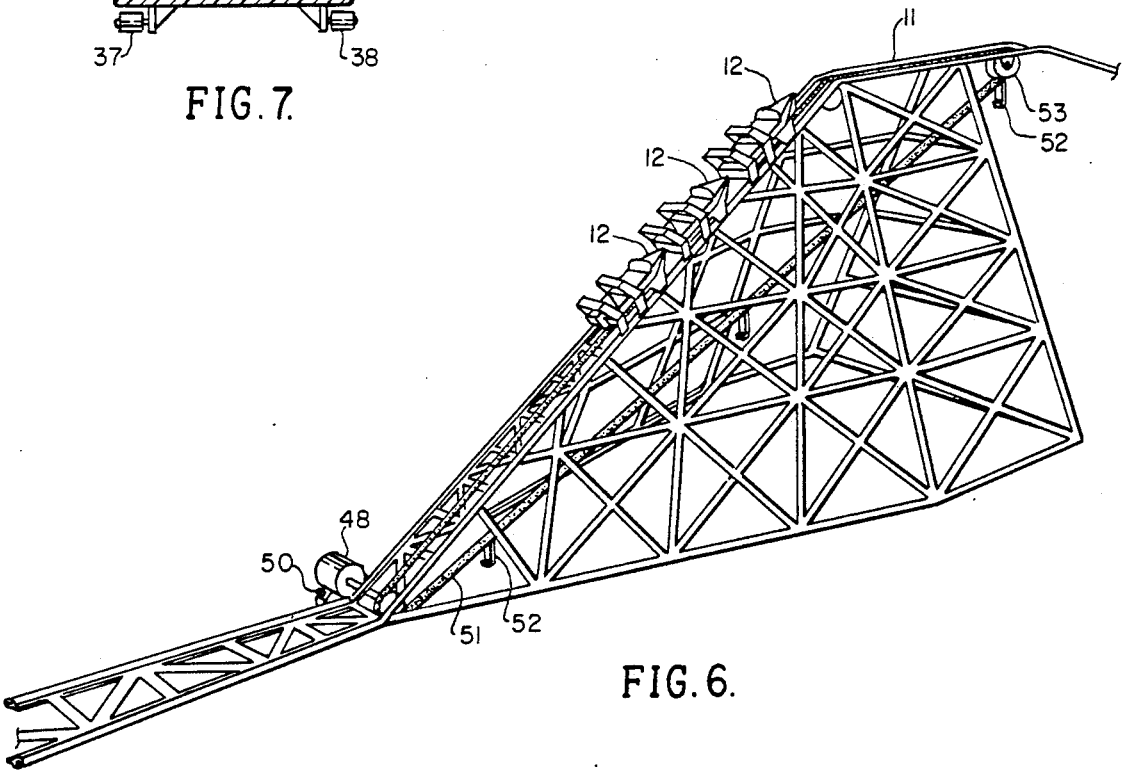
FIG. 6 is a perspective view of the track layout showing a conveyor or vehicle lift system for engaging with the toy vehicle and elevating the vehicle to a starting position.

As illustrated in FIG. 6, a conveyor system is illustrated for lifting the toy vehicles 12 to an elevated position on the track 11. The lift or conveyor system consists of a motor 48 which is activated by a trip switch 50 whenever a vehicle passes over the switch. At this time, a belt 51 provided with hooks 52 that are attached at regular intervals along the length of the belt begins to turn. The hooks connect with the vehicles and pull them to the top of the conveyor track where they are released as the hooks turn about a turning wheel 53 to disengage with the vehicle. Sound effects may be provided which duplicate the "clackity" sound as the vehicle is raised while realistic "screaming" sounds play continuously from a remote sound system (not shown).

Other details and accessories may include a "C-Clamp" track support that can be attached to the edge of tables or chairs taking the place of towers. Also, a suction cup device may be employed for the same purpose on windows or other surfaces.

Figure 7:
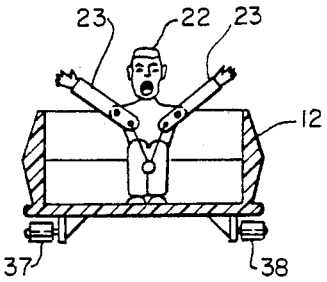
FIG. 7 is a diagrammatic view of a toy vehicle incorporating a figure or character having movable extremities operated in accordance with centrifugal or inertial forces while the vehicle travels along the track.

Referring now in detail to FIG. 7, a miniature character imitating a person is indicated by numeral 22 with pivoting arms 23 that are counter-balanced so they will raise up and down with the motion of the vehicle as it travels along the path of the track. Preferably, the character 22 will be provided with "funny" facial expressions of wide-eyed terror so as to provide a visual and comical reality to the play.

In view of the foregoing, it can be seen that the novel mechanical toy of the present invention provides an enjoyable and entertaining as well as amusing device for children. The vehicle is gravity powered and does not require a source of power that is either carried on the vehicle or on the track itself. A variety of track layout is available because of the universal joint mount on the top of each tower and because each tower can be adjusted in height. Height is achieved by using one or more of the tower sections separately or in combination as well as by rotating the turning collars which threadably join the opposite ends of the tower sections. A variety of bases can be employed ranging from suction cups and weighted bases to hollow containers into which water, sand or the like can be poured. The three wheel or roller arrangement for movably supporting the vehicle on the track is unique in that the under wheel of the three may be selectively actuated to a lateral or outward position from under the track by a pinching movement via the actuating member 44. The side members 40 and 41 operate as pivoting levers between the two positions shown in FIG. 5.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A toy vehicle and track system comprising the combination of:

a continuous track arranged in a tortuous path elevated above a supporting surface;

a plurality of height-adjustable towers in spaced-apart relationship supporting said track on said supporting surface;

a gravity operated vehicle having support rollers movably carried on said elevated track;

retaining and guide means operably carried on opposite sides of said vehicle selectively engageable with opposite sides of and beneath said track for releasably maintaining said vehicle on said track;

said vehicle retaining and guide means include a pair of rollers carried on each side of said vehicle in rollable engagement with opposite sides of and the underside of said track;

each pair of said retaining and guide means rollers comprising a first roller engageable with the side of said track and a second roller engageable with the underside of said track, said pair of rollers having turning axles normal with respect to each other;

said retaining and guide means include a pivoted lever member on each side of said vehicle having an end portion extending beyond said vehicle and terminating with said second roller projecting inwardly under said track in rollable engagement with opposite undersides thereof; and actuation means pivotally interconnecting ends of said lever members opposite to their ends carrying said second roller for manually deploying said second rollers beneath said track and to release and remove said second rollers from beneath said track.

2. The invention as defined in claim 1 including;

universal joint means operably disposed between said tower and said track to permit articulated movement therebetween to provide omni-directional positioning of said track respective to said tower.

3. The invention as defined in claim 2 wherein;

said universal joint means includes a coupler track removably connecting opposite ends of track sections constituting said continuous track;

said universal joint means further having a ball member carried on the underside of coupler track movably held in a socket carried on the end of said tower; and a collar rotatably carried on said tower for tightening about said socket to hold said ball member and said coupler track in a fixed position.

4. The invention as defined in claim 1 including;

a vehicle lift conveyor constituting a part of said track having a power operated belted hook arrangement for lifting said vehicle to an elevated position on said track preparatory for gravity operation.

5. The invention as defined in claim 4 wherein;

said vehicle includes a character having arm members pivotally carried on a torso and including counter-balance means responsive to centrifugal and inertia forces to pivot about said torso.

6. The invention as defined in claim 1 wherein:

said vehicle support rollers, said side first rollers and said underside second rollers cooperate to define a three point support, retention and guide means for said vehicle on said track.

7. A toy vehicle and track system comprising the combination of:

a continuous track arranged in a tortuous path elevated above a supporting surface;

a plurality of height-adjustable towers in spaced-apart relationship supporting said track on said supporting surface;

a gravity operated vehicle having support rollers movably carried on said elevated track;

retaining and guide means operably carried on opposite sides of said vehicle selectively engageable with opposite sides of and beneath said track for releasably maintaining said vehicle on said track;

said vehicle retaining and guide means include a pair of rollers carried on each side of said vehicle in rollable engagement with opposite sides of and the underside of said track;

each pair of said retaining and guide means rollers comprising a first roller engageable with the side of said track and a second roller engageable with the underside of said track, said pair of rollers having turning axles normal with respect to each other;

said retaining and guide means include a pivoted lever member on each side of said vehicle having an end portion extending beyond said vehicle and terminating with said second roller projecting inwardly under staid track in rollable engagement with opposite undersides thereof;

each of said pivoted lever members includes an actuation portion extending from said end portion above said vehicle and pivotally joined with said actuation portion of the other lever member;

a pivot connection on each of said lever members joining said lever members to the respective sides of said vehicle;

said pivot connections being operable to extend and retract said second rollers away from and back to said underside track position in response to manual pinching of said actuation portions.

* * * * *